US007568704B1

(12) United States Patent
Davis et al.

(10) Patent No.: US 7,568,704 B1
(45) Date of Patent: Aug. 4, 2009

(54) METHOD OF PLAYING BLACKJACK WITH A BONUS BET

(76) Inventors: David A. Davis, 236 Defiance Rd., Defiance, MO (US) 63341; Robin R. Davis, 236 Defiance Rd., Defiance, MO (US) 63341

( * ) Notice: Subject to any disclaimer, the term of this patent is extended or adjusted under 35 U.S.C. 154(b) by 0 days.

(21) Appl. No.: 12/032,924

(22) Filed: Feb. 18, 2008

(51) Int. Cl.
*A63F 9/20* (2006.01)

(52) U.S. Cl. ..... 273/292; 273/303; 463/12; 463/13

(58) Field of Classification Search ..... 273/292, 273/303; 463/12, 13
See application file for complete search history.

(56) References Cited

U.S. PATENT DOCUMENTS

| | | | | | |
|---|---|---|---|---|---|
| 5,174,579 | A | | 12/1992 | Griffiths | |
| 5,265,882 | A | * | 11/1993 | Malek | 273/292 |
| 5,275,416 | A | * | 1/1994 | Schorr et al. | 273/292 |
| 5,377,993 | A | * | 1/1995 | Josephs | 463/12 |
| 5,636,843 | A | * | 6/1997 | Roberts | 273/292 |
| 5,743,532 | A | | 4/1998 | Lafferty | |
| 5,816,575 | A | * | 10/1998 | Keller | 273/292 |
| 5,984,308 | A | | 11/1999 | Herrmann | |
| 6,095,525 | A | | 8/2000 | Terminel | |
| 6,206,375 | B1 | | 3/2001 | Wichinsky | |
| 6,773,013 | B2 | * | 8/2004 | Caldwell | 273/292 |
| 6,874,786 | B2 | | 4/2005 | Bruno et al. | |
| 7,175,180 | B2 | | 2/2007 | Webb | |
| 7,222,854 | B2 | | 5/2007 | Sorge | |
| 2002/0036382 | A1 | | 3/2002 | Brunelle | |
| 2002/0045471 | A1 | | 4/2002 | Cranford | |
| 2005/0194742 | A1 | * | 9/2005 | Donaldson | 273/292 |
| 2006/0014577 | A1 | * | 1/2006 | Snow | 463/12 |
| 2006/0082065 | A1 | | 4/2006 | Falciglia, Sr. | |
| 2007/0158910 | A1 | | 7/2007 | Mendola et al. | |
| 2007/0167206 | A1 | | 7/2007 | Kirkutis | |

* cited by examiner

*Primary Examiner*—Gene Kim
*Assistant Examiner*—Alexander R Niconovich
(74) *Attorney, Agent, or Firm*—Grace J. Fishel

(57) ABSTRACT

A method for playing live and electronic Blackjack-style games with an optional bonus bet wherein a player bets that he or she will be dealt a natural Blackjack hand. Unless the dealer is also dealt a natural Blackjack hand, the player continues playing Blackjack with his or her natural Blackjack hand reevaluated as a hard hand eleven. If the player beats the dealer, the player is paid 3:2 for his or her base bet and at a significantly higher payout for his or her bonus bet without interfering with the rhythm of the game for other players who want to play Blackjack conventionally. If the dealer is also dealt a natural Blackjack, a player with a natural Blackjack is paid at a significantly higher payout for his or her bonus bet while the base bet is a push.

7 Claims, 2 Drawing Sheets

Pay outs on Original Bonus Bets

28

| | 20 | 10 |
|---|---|---|
| 5 | 100 | 50 |
| 10 | 200 | 100 |
| 15 | 300 | 150 |
| 20 | 400 | 200 |
| 25 | 500 | 250 |

20 x bonus bet if hand is played out without doubling down.
10 x bonus bet if player doubles down for one card only.

NOTE: If the dealer and a player have blackjack, the bonus bet gets paid 4 to 1 and the original bet is pushed.

METHOD OF PLAYING BLACKJACK WITH A BONUS BET

BACKGROUND OF THE INVENTION

1. Field of the Invention

The present invention relates to a method of playing cards which follows conventional Blackjack rules for the most part, but which makes available an optional bonus bet which enhances the payout in the event a player is dealt a natural Blackjack hand without interfering with the rhythm of the game.

2. Brief Description of the Prior Art

Because of the small percentage difference in the odds of playing Blackjack against the dealer, the same chips are passed back and forth from the player to the dealer (when the Blackjack player loses) and from the dealer back to the player (when the dealer loses) for relatively long periods of time. For this reason Blackjack may become boring to some players. To maintain long-term interest, it is therefore desirable to offer a bonus bet that permits the Blackjack player to have the excitement of a chance to win big other than just by varying the size of his or her base bet.

There are a number of variations on Blackjack with a bonus bet. In evaluating these variations, it is important to keep in mind that a casino typically seeks to attract as many participants to a game as possible to increase the money collected at the gaming table. In addition, the number of games played during a specified time, such as the number of hands per hour, is an important metric used to evaluate the return potential for a game. That is, the more hands that are played during a unit of time, the greater the money collected by the house and the corresponding profit realized.

The problem with existing variations on Blackjack having a bonus bet is that they slow down the Blackjack game. For example, there is game called 21+3 which combines a basic Blackjack bet with an optional 3-card Poker bet. In this game, each player is dealt two cards face-up and the dealer is dealt two cards, one up and the last one down. At this point, the outcome of each 3-card Poker hand is determined, where a 3-card Poker hand consists of the 2-card hand dealt to that player and the dealer's face-up card. After settling the Poker bets, the game of Blackjack continues in a typical fashion. The Poker game slows down the Blackjack game and may drive away those players who just want to play Blackjack, reducing the casino's profit.

BRIEF SUMMARY OF THE INVENTION

In view of the above, it is an object of the present invention to provide a variant on Blackjack with a bonus bet that does not interfere with the rhythm of the Blackjack game. It is another object to provide a variant on Blackjack which may be played as an electronic or a live card game with a dealer. It is also an object to provide a variant on Blackjack with a bonus bet which may be supplemented with other betting procedures such as surrender, insurance, doubling down, splitting pairs and the like. Other objects and features of the invention will be in part apparent and in part pointed out hereinafter.

In accordance with the present invention, a method of playing Blackjack with an optional bonus bet is provided. The method requires a dealer, at least one player and at least one standard deck of cards and comprises the steps of:

a) providing a physical deck of playing cards or an electronic representation of cards on an electronic display b) a player placing a standard Blackjack base bet, c) the same player as in (a) placing a bonus bet that he or she will be dealt a natural Blackjack hand, d) a dealer dealing two cards to the player in (b) and two cards to the dealer, e) if a natural Blackjack hand is dealt to the player in (c) and if the dealer is not also dealt a natural Blackjack hand, the player in (c) continues playing Blackjack with his or her natural Blackjack hand taken as a hard hand counted as eleven and the dealer pays off the base bet but if the dealer is also dealt a natural Blackjack hand, the player in (c) is paid for the bonus bet according to a pre-established payout scheme and the base bet is a push, f) if the player in (d) beats the dealer with his or her hard hand, the dealer pays off the player in (d) for the bonus bet according to a pre-established payout scheme, and, g) if a natural Blackjack hand is not dealt to the player in (c), the bonus bet is lost and the player in (c) continues playing Blackjack for his or her base bet.

The above-described game may be played as a live card game or electronically. It may also be supplemented with other betting procedures such as surrender, insurance, doubling down and splitting pairs. A possible payout scheme for the player who beats the dealer with his or her natural Blackjack hand reevaluated as a hard hand eleven is 10:1 if the player has doubled down and 20:1 if he or she does not double down. If the dealer has a natural Blackjack hand, the player who was dealt a natural Blackjack hand is paid 4:1. Other odds may be set at the discretion of the casino depending on the money to be kept by the house.

The invention summarized above comprises the method of play hereinafter described, the scope of the invention being indicated by the subjoined claims.

BRIEF DESCRIPTION OF THE SEVERAL VIEWS OF THE DRAWING

In the accompanying drawings, in which one of various possible embodiments of the invention is illustrated, corresponding reference characters refer to corresponding parts throughout the several views of the drawings in which.

DETAILED DESCRIPTION OF THE INVENTION

Figure 1:
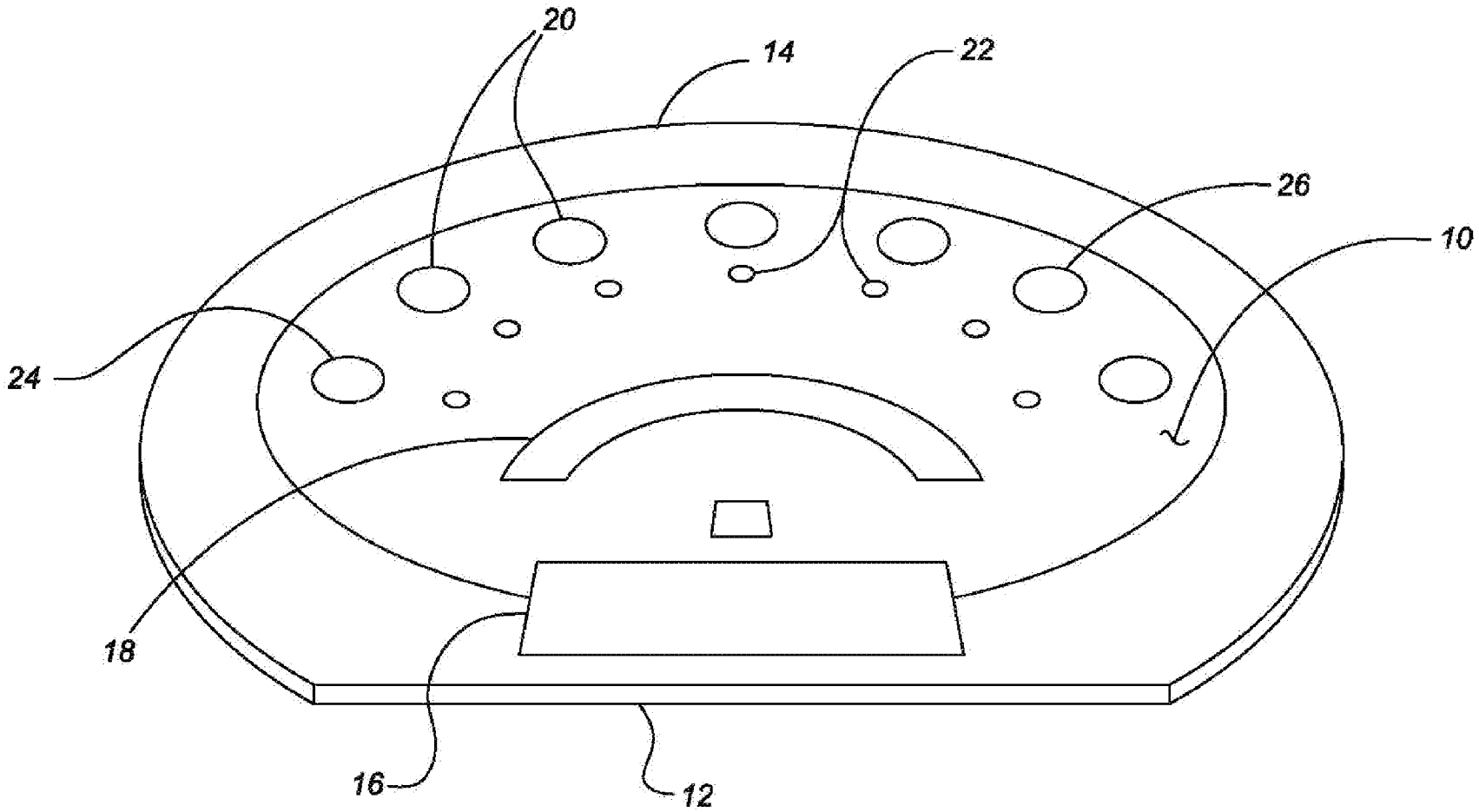
FIG. 1 shows a table layout with seven player locations for a variation on Blackjack with a bonus bet in accordance with the present invention.

Referring to the drawings more particularly by reference character, a method of playing Blackjack (also called twenty-one) with a bonus bet in accordance with the present invention is played on a real or simulated playing surface 10. In the embodiment shown in FIG. 1, real playing surface 10 is preferably covered with felt or other material that is secured to the top of a casino-style table with a straight edge 12 behind which a dealer stands facing the players and a semi-circular edge 14 around which one or more players sit or stand facing the dealer.

The covering on playing surface 10 may be imprinted with various indicia including text describing basic house rules of play, e.g., dealer must hit a soft 17. With continuing reference to FIG. 1, playing surface 10 includes marked areas preprinted on the felt. A substantially rectangular area 16 is typically provided proximate a dealer for holding the cards which are played by the dealer and chips for the gaming establishment which are used by the dealer to pay or take player bets. Playing surface 10 typically includes an arcuate portion 18 which separates the dealer's cards and playing portion from the player's playing portion. In one non-limiting embodiment, arcuate portion 18 is referred to as "the insurance line" and allows a "side bet" to occur during a round of blackjack.

It should be appreciated that playing surface 10 may have any desired shape and size and that nothing in this description is meant to limit playing surface 10 to any particular size and shape and that playing surface 10 may be formed in the top of a table or other such object. It should be further appreciated that playing surface 10 can be simulated on a video screen and the game can be played via a computer under software control with the cards being simulated and the players participating via an interactive video station.

In the player's playing portion of playing surface 10 there are multiple locations for players, typically seven as shown in FIG. 1. Printed on playing surface 10 in front of each player location are betting spots 20 for placing a base bet in Blackjack and also auxiliary betting spots 22 for placing an optional bonus bet. While base betting spot 20 and bonus betting spot 22 are shown as circles in FIGS. 1 and 2, it will be understood that the locations may be marked with other shapes or symbols such as a square or rectangle or an x or a dot. Although seven player positions are shown in FIG. 1, more players or as few as one player and one dealer may play the game. The first seat on the dealer's left is conventionally referred to as First Base 24, and the first seat on the dealer's right is referred to as Third Base 26.

Blackjack is played with one or more standard decks of 52 cards. Cards 2 through 10 are worth their face value and face cards (jack, queen and king) are also worth ten. An ace's value may be either eleven or one. A hand in which the ace's value is counted as eleven is called a soft hand, because the hand cannot be busted if the player draws another card. A hand in which the ace's value is counted as one is called a hard hand.

When multiple decks are used, there is usually an even number of decks (e.g., 2, 4, 6, 8) although some casinos use five or seven decks. The use of multiple decks permits the dealer to deal more hands per hour, thereby increasing the casino take, and it reduces (but does not eliminate) the player advantage gained from card counting. In multi-deck games, the cards are dealt out of a tray-like box called a shoe and some casinos use continuous shufflers.

At the beginning of each round of Blackjack play, each player indicates his or her base bet by placing one or more chips, markers, or other wagering devices in base betting spot 20. The amount of base bet which a player may make for a particular game or table may be regulated between certain maximum and minimum values by a casino or other authority. Each player may make an additional, bonus bet by placing one or more chips, markers, or other wagering devices in bonus betting spot 22. The placing of an additional bonus bet is optional, and a player may elect not to place an additional bonus bet in a particular game or round of play and still participate in that particular game or round of play provided the player has made a base bet.

When all bets have been placed in betting spots 20 and 22, the dealer deals two cards, one at a time to each player following the rules of conventional Blackjack. Depending on the variant of Blackjack, the players' cards are dealt either face down or face up. The dealer receives one card face down and one card face-up. If the dealer was dealt a natural Blackjack hand (i.e., an ace and a ten-value card), all players lose both their base bets and bonus bets, except those players who also have a natural Blackjack hand 27 (FIG. 2), who push as to the base bet and are paid on the bonus bet, for example 4:1.

After the dealer and players have been dealt an initial hand of two cards, each player in turn starting with First Base elects to receive one or more additional cards ("hit") or to take no additional cards ("stand"). A player may elect to take additional cards until he or she decides to stand or until the point total of the player's hand exceeds twenty-one, known as "busting."

In the subject method of play, a player who was dealt a natural Blackjack hand 27 and who made a bonus bet will be paid for the Blackjack but continue play after the Blackjack hand is paid by the dealer or noted by the dealer for payment at the end of the round. In a usual Blackjack game, play for that player is over but in the subject invention, the player's hand is reevaluated as "eleven" (i.e., the natural Blackjack hand 27 is converted into a hard hand with the ace counted as one) and the player takes additional cards until he or she decides to stand or until the point total of the player's hand exceeds twenty-one.

The game of Blackjack as described above may be supplemented with a number of alternative betting procedures, including surrender, insurance, doubling down, and splitting pairs.

Once all players have either received the desired number of cards or busted, including the players who were dealt a natural Blackjack hand with the first two cards, the dealer then takes additional cards or stands. Under most Blackjack rules, a dealer is not permitted to receive additional cards if the dealer's existing hand has a total point value of seventeen or greater and a dealer is required to take an additional card if the dealer's existing hand has a point total of less than seventeen.

Figures 2, 3:
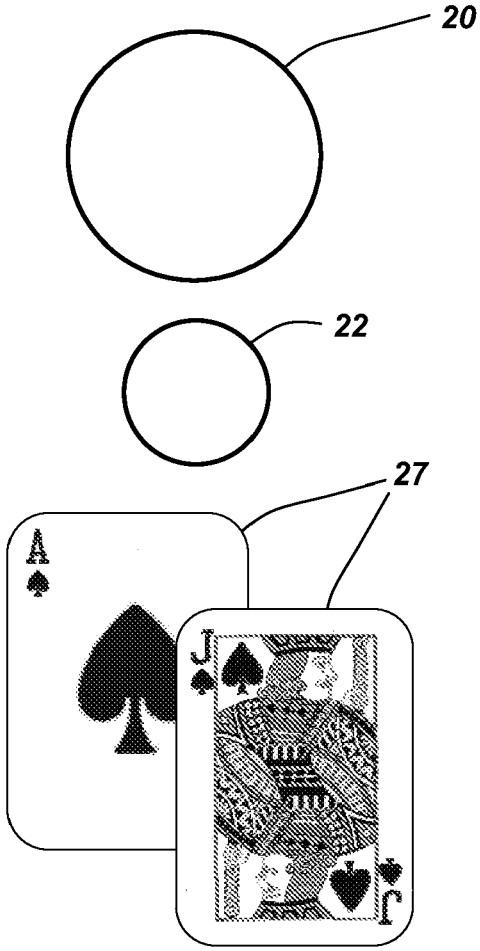
FIG. 2 shows a player's location on an enlarged scale.
FIG. 3 is a table showing one possible casino payout schedule.

When all of the players and the dealer have either received a desired number of cards or busted, the outcome of the game is determined. A player wins if either the dealer's point total exceeds twenty-one (i.e., the dealer busts) or if the player's point total exceeds the dealer's point total. The payout, however, is different for those players who were dealt a natural Blackjack hand with the first two cards and for those who were not:

(1) In the case of those players who were not dealt a natural Blackjack with the first two cards, they lose their bonus bet but are paid 2:1 on their base bet, i.e., an amount equal to his or her initial base bet in addition to receiving his or her initial base bet back; but, (2) In the case of those players who were dealt a natural Blackjack hand with the first two cards, they are paid 3:2 on their base bet for the Blackjack and then at a significantly higher payout for their bonus bet in accordance with a schedule 28 such as shown in FIG. 3. Schedule 28 is established by the casino and published to the players before play commences. Since the odds favor the casino if the player does not double down, the bonus payouts for with and without doubling down are different.

As described above, the method of playing Blackjack with a bonus bet in accordance with the present invention presents a player with the opportunity for a significant payout. The game retains the basic nature of Blackjack without interfering with the rhythm of the game. If the players' cards are dealt face up, a dealer may immediately sweep away the bonus bets of those players who were not dealt a natural Blackjack hand and without interruption deal additional cards to the players who elect to take them, including in sequence those players who were dealt a Blackjack hand. At the end of the round, the dealer settles all base bets including those of the players who were dealt a natural Blackjack hand (if not paid earlier) and the bonus bets for those who were dealt a natural Blackjack hand and then "beat the dealer" playing the natural Blackjack hand as a hard hand.

In view of the above, it will be seen that the several objects of the invention are achieved and other advantageous results attained. As various changes could be made in the above method of play without departing from the scope of the invention, it is intended that all matter contained in the above description or shown in the accompanying drawings shall be interpreted as illustrative and not in a limiting sense.

What is claimed:

1. A method of playing a variant of Blackjack with a dealer, at least one player, and at least one standard deck of cards comprising the steps of:

a) providing a physical deck of playing cards or an electronic representation of cards on an electronic display b) a player placing a standard Blackjack base bet, c) the same player as in (a) placing a bonus bet that he or she will be dealt a natural Blackjack hand, d) a dealer dealing two cards to the player in (b) and two cards to the dealer, e) if a natural Blackjack hand is dealt to the player in (c) and if the dealer is not also dealt a natural Blackjack hand, the player in (c) continues playing Blackjack with his or her natural Blackjack hand taken as a hard hand counted as eleven and the dealer pays off the base bet but if the dealer is also dealt a natural Blackjack hand, the player in (c) is paid on the bonus bet according to a pre-established payout scheme and the base bet is a push, f) if the player in (d) beats the dealer with his or her hard hand, the dealer pays off the player in (d) for the bonus bet according to a pre-established payout scheme, and, g) if a natural Blackjack hand is not dealt to the player in (c), the bonus bet is lost and the player in (c) continues playing Blackjack for his or her base bet.

2. The method of claim 1 played as a live card game.

3. The method of claim 1 played as an electronic game.

4. The method of claim 1 supplemented with one or more betting procedures selected from the group consisting of surrender, insurance, doubling down and splitting pairs.

5. The method of claim 1 wherein multiple decks of cards are used.

6. The method of claim 1 wherein the payout scheme is 15:1 if the player in (d) doubles down.

7. The method of claim 1 wherein the payout scheme is 30:1 if the player in (d) does not double down.

* * * * *

UNITED STATES PATENT AND TRADEMARK OFFICE

CERTIFICATE OF CORRECTION

PATENT NO. : 7,568,704 B1
APPLICATION NO. : 12/032924
DATED : August 4, 2009
INVENTOR(S) : David A. Davis and Robin R. Davis It is certified that error appears in the above-identified patent and that said Letters Patent is hereby corrected as shown below:

Column 2, line 1, (a) should be (b);
Column 2, line 3, (b) should be (c);
Column 2, line 5, (c) should be (d);
Column 2, line 7, (c) should be (d);
Column 2, line 10, (c) should be (d);
Column 2, line 13, (d) should be (e);
Column 2, line 14, (d) should be (e);
Column 2, line 17, first and second (c) should be (d);
Column 5, line 15, (a) should be (b);
Column 5, line 17, (b) should be (c);
Column 5, line 19, (c) should be (d);
Column 5, line 21, (c) should be (d);
Column 6, line 3, (c) should be (d);
Column 6, line 5, (d) should be (e);
Column 6, line 6, (d) should be (e)
Column 6, line 9, first and second (c) should be (d);
Column 6, line 19, (d) should be (e); and,
Column 6, line 21, (d) should be (e).

Signed and Sealed this

Fifteenth Day of September, 2009

David J. Kappos

David J. Kappos
*Director of the United States Patent and Trademark Office*